United States Patent [19]

Yanagisawa et al.

[11] 4,350,877

[45] Sep. 21, 1982

[54] CALCULATING RULE USEFUL FOR MAKING EYEGLASSES

[75] Inventors: Yasuo Yanagisawa, Akishima; Yoshiaki Mitsui, Hino, both of Japan

[73] Assignee: Hoya Lens Corporation, Tokyo, Japan

[21] Appl. No.: 170,252

[22] Filed: Jul. 18, 1980

[30] Foreign Application Priority Data

Jul. 23, 1979 [JP] Japan ..... 54-101444[U]

[51] Int. Cl.[3] ..... G06G 1/06; G06G 1/08

[52] U.S. Cl. ..... 235/70 A; 235/78 R

[58] Field of Search ..... 181/70 R–70 D, 181/78 R

[56] References Cited

U.S. PATENT DOCUMENTS 2,193,280 3/1940 Gunning ..... 235/70 R

FOREIGN PATENT DOCUMENTS 53-7839 3/1978 Japan .

*Primary Examiner*—L. T. Hix

*Assistant Examiner*—Thomas H. Tarcza

*Attorney, Agent, or Firm*—Sprung, Horn, Kramer & Woods

[57] ABSTRACT

A calculating rule for obtaining ophthalmic values which are necessary for making eyeglasses, such as near-point distance, far-point distance, visual range, and addition, especially by which the eyeglasses-wearer can continue his work at the objective working distance with no asthenopia based on accommodation, from other ophthalmic values such as power of the ametropia, accommodation, etc., and for obtaining the resultant prism-diopter and base-direction of the prism for correcting heterophoria. The calculating rule comprises a rectangular slide rule and a circular rotating rule: the slide rule comprising a fixed rule consisting of scale (A) and accommodation and scale (D) of near-point distance, and a slide rule consisting of scale (B) of power of the ametropia equal to addition and scale (C) of far-point distance, and the marks for indicating, on the scale (D), near-point distance and the objective working distances with no asthenopia which vary in accordance with the accommodations; the circular rotating rule comprising a fixed circular rule (E) and a rotating circular rule (F).

2 Claims, 2 Drawing Figures

CALCULATING RULE USEFUL FOR MAKING EYEGLASSES

BACKGROUND OF THE INVENTION

1. Field of the Invention

This invention relates to a calculating rule useful for making eyeglasses meeting the eyes wearing the eyeglasses.

2. Description of the Prior Art

Making good eyeglasses requires for the maker to master meanings of power of the ametropia, accommodation, near-point, far-point, visual range, and addition, and the relationships thereof, and the calculation of obtaining any value from other values thereof, and to master the calculation for obtaining a resultant prism-diopter and base-direction from two prisms, each of which is characterized by the respective prism-diopter and base-direction, because heterophoria is ordinally represented by two prisms which have a respective prism-diopter and a respective base-direction, the two base-directions of the two prisms being any pair of orthogonal upward, downward, inward, and outward directions.

Mastering said businesses is not so easy for every maker. However, there has been heretofore no good means for helping master said businesses, except for the calculating rule disclosed by Japanese patent publication No. 7839/1978.

The calculating rule comprises a rectangular fixed rule and a rectangular slide rule; the fixed rule having two scales (A) and (D) that are apart from each other, the upper scale (A) being a scale of "accommodation" in dioptric unit and the lower scale (D) being a scale of "near-point distance" in centimeter unit, and the slide rule that slides between the upper scale (A) and the lower scale (D) having a scale (B) of "power of the ametropia" in dioptric unit that is also a scale of "addition" in dioptric unit, and a scale (C) of "far-point distance" in centimeter unit, and further, at the left end of the scale (C), an arrow mark for indicating the position of "near-point distance" on the scale (D).

The calculating rule enables to master the meanings of power of the ametropia, accommodation, near-point, far-point, visual range, and addition, and the relationships thereof, and to facilitate the calculation for obtaining any value from other values thereof.

SUMMARY OF THE INVENTION

An object of this invention is to provide an improved calculating rule that can further obtain the addition by which the eyeglasses-wearer can continue his work at the objective working distance with no asthenopia based on accommodation, and simultaneously can obtain the resultant prism-diopter and base-direction of the prism for correcting heterophoria, in addition to the performance of the prior calculating rule.

This invention concerns with a calculating rule which comprises a rule for ametropia and a rule for heterophoria: the rule for ametropia consisting of a rectangular fixed rule and a rectangular slide rule; the fixed rule having two scales (A) and (D) that are apart from each other, the upper scale (A) being the scale of "accommodation" in dioptric unit and the lower scale (D) being the scale of "near-point distance" and also "objective working distance" in centimeter unit; the scale (A) consisting of a left half scale using for the calculation in the case of both emmetropia and myopia and a right half scale using for the calculation in the case of hyperopia, each half scale graduating from the center 0 to each end of 4.00, and the scale (D) consisting of a left half scale which is used for emmetropia and myopia and represents the value before retina, and a right half scale whih is used for hyperopia and represents the value behind retina; the slide rule that slides between the scale (A) and (D) of the fixed rule having a scale (B) of "power of the ametropia" in dioptric unit that is also the scale of "addition" in dioptric unit, and a scale (C) of "far-point distance" in centimeter unit, the scale (B) graduating from 0 of the left end to 8.00 of the right end, and the scale (C) graduating from 12.5 of the right end to infinitive ($\infty$) of the left end; the slide rule also having, at the left end of the scale (B), (C), an arrow mark (1) for designating the near-point distance on the scale (D); the rule for ametropia further having dividing the left half of the accommodation scale (A) into several regions (1), (2), (3), . . . , and several arrow marks (1), (2), (3), . . . , in correspondence with the several regions, (1), (2), (3), . . . , each of which designates a respective objective working distance standing for the distance at which the eye having a value of accommodation in a definite region has to see and can continue to see with no asthenopia based on accommodation; and the rule for heterophoria consisting of a fixed circular rule (E) and a rotating circular rule (F); the fixed circular rule (E) having a counterclockwise circular scale graduated from zero to 360, in which the horizontal center-line is 0°–180° and the vertical center-line is 90°–270°, and a circular space which is divided by the horizontal center-line and the vertical center-line into four quardrants, each of which graduates cross-sectionally in orthogonal coordinates such as 0, 1, 2, 3, 4, 5, 6, 7, 8, and a sign "UP" for upward first and second quardrants, a sign "DOWN" for downward third and fourth quardrants, and signs "OUT-R-IN" and "IN-L-OUT" which span the vertical center-line, in which R represents right eye, L represents left eye, "OUT"0 represents outward (ear-side), and "IN" rpresents inward (nose-side); and the rotating circular scale (F) is a transparent circular plate rotating at the axis that is the center of the fixed circular rule (E), which has a cursor that is a straight center-line graduated such as 0, 1, 2, 3, 4, 5, 6, 7 from the center to both directions with the same graduation as the fixed circular scale (E).

DETAILED DESCRIPTION OF THE PREFERRED EMBODIMENTS

Figure 1:
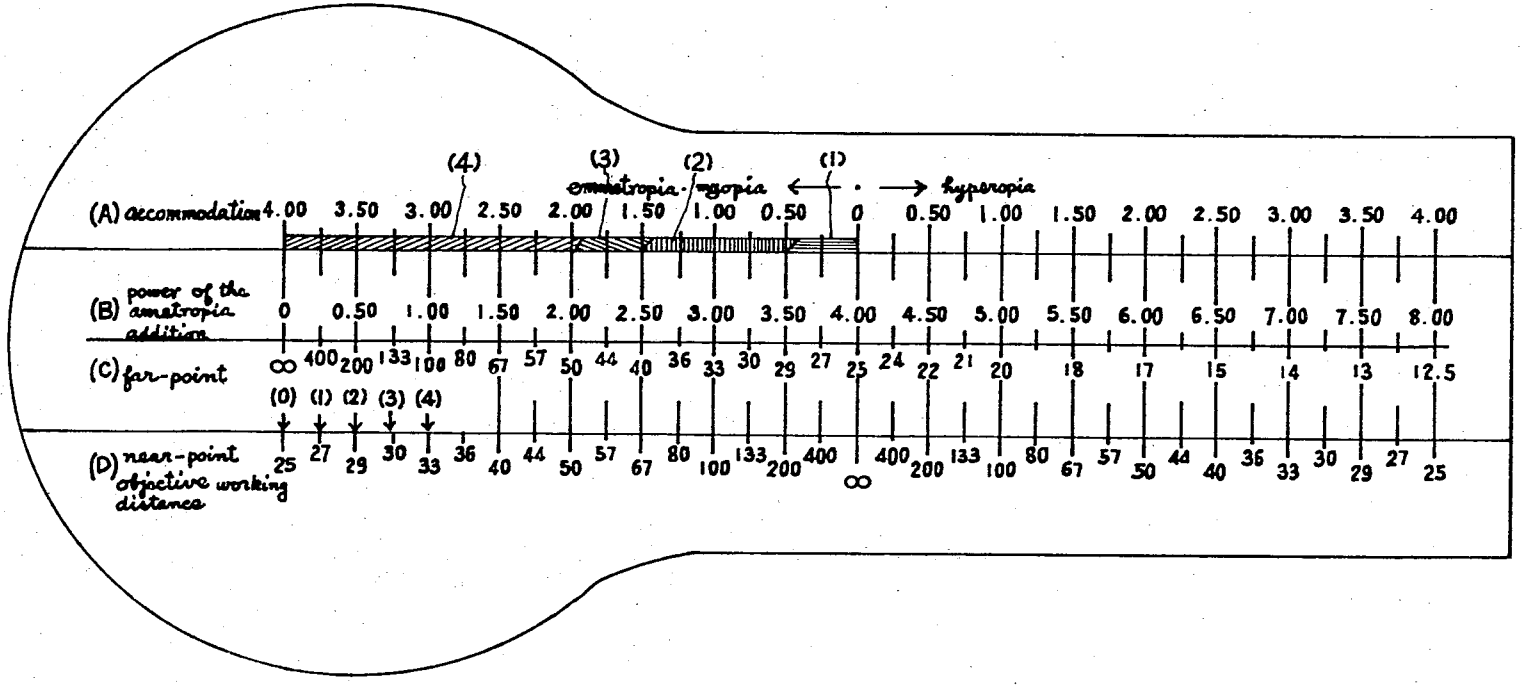
FIG. 1 shows a plan view of the side for ametropia of a calculation rule of this invention.

Embodiments of this invention are illustrated as follows:

In FIG. 1, (A) and (D) are the scales of the fixed rule, and (B) and (C) are the scales of the slide rule. Scale (A) is the scale for "accommodation" in dioptric unit, and scale (D) is the scale for "near-point distance" in centimeter unit, and is also the scale for "objective working distance". Hence, the objective working distance means the distance between the eyes and the place that the eyeglasses-wearer does the near work actually with no asthenopia based on accommodation.

Scale (B) is the scale for "power of the ametropia" in dioptric unit, and also "addition" in dioptric unit. Scale (C) is the scale for "far-point distance" in centimeter unit. Scales of (A), (B), (C), and (D) are graduated as shown in FIG. 1. The half left sides of scales (A) and (D) are the scales to be used for emmetropia and myopia, and the half right side of scales (A) and (D) are the scales to be used for hyperopia.

The half left side of scale (A) is divided into four regions which may be practically discriminated by different colorings, the first region ranges from 0 to 0.50 diopter, the second region ranges from 0.50 to 1.50 diopters, the third region ranges from 1.50 to 2.00 diopters, and the fourth region ranges from 2.00 to 4.00 diopters.

The slide rule has five arrow marks at the left side of the scale of the lower edge. Most outside arrow mark (0) is used for indicating the near-point distance on scale (D). Next the first, second, third, and fourth arrow marks (1), (2), (3), and (4) are used respectively for indicating the respective objective working distance in correspondence with the first, second, third, and fourth region of scale (A). The arrow mark (1) is at the position of 1.2 graduates-distance from arrow mark (0), the arrow mark (2) is at the position of 2.2 graduates-distance from arrow mark (0), the arrow mark (3) is at the position of 2.8 graduates-distance from arrow mark (0), and the arrow mark (4) is at the position of 3.7 graduates-distance from arrow mark (0).

Figure 2:
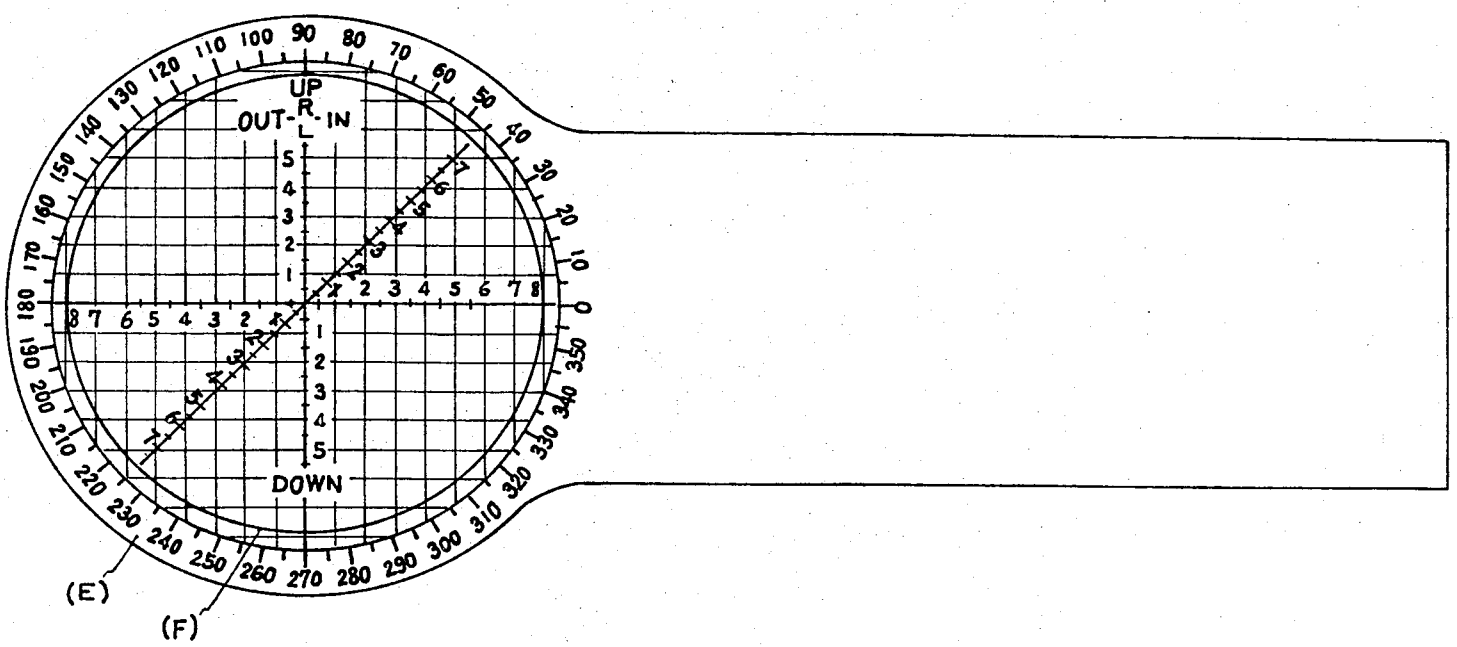
FIG. 2 shows a plan view of the side for heterophoria of a calculation rule of this invention.

In FIG. 2, (E) is a fixed circular rule, and (F) is a rotating circular rule. Rotating circular rule (F) is a transparent circular plate which rotates at the axis which is the center of the fixed circular rule (E). Fixed circular rule (E) has, on the circle, a counter-clockwise angular graduation of 0 to 360, and has a horizontal center-line of 0°–180°, and a vertical center-line of 90°–270°. The space of fixed circular rule (E) is divided into four quardrants, each of which has an orthogonal coordinates graduated cross-sectionally as 0, 1, 2, 3, 4, 5, 6, 7, 8 from the center 0 toward the circle. As shown in FIG. 2, the signs UP, OUT-R-IN, and IN-L-OUT are laid across the vertical centerline 90°–270° on the upper part of the fixed rule. UP corresponds to hyperphoria and DOWN on the lower part corresponds to hypophoria. R denotes right eye, and L denotes left eye. IN corresponds to esophoria, and OUT corresponds to exophoria.

Examples using the rule for ametropia (A), (B), (C), and (D) are illustrated as follows:

EXAMPLE 1

Far-point distance and near-point distance of the emmetropic eye of 2.00 diopters of accommodation If 0 of scale (B) is stopped at left 2.00 of scale (A), then the far-point distance is indicated on scale (C) as ∞ cm corresponding to 0 of scale (B), and the near-point distance is indicated by arrow mark (0) on scale (D) as 50 cm.

EXAMPLE 2

Far-point distance and near-point distance of the hyperopic eye of 1.00 diopter of power of the ametropia and 2.00 diopters accommodation If 1.00 of scale (B) is stopped at right 2.00 of scale (A), then the far-point distance is indicated as 100 cm of the distance behind the retina on scale (C) corresponding to 1.00 of scale (B), and the near-point distance is indicated as 100 cm of the distance in front of the retina on scale (D) by the arrow mark (0). If power of the hyperopia is smaller than accommodation, then the far-point appears behind the retina and the near-point appears in front of the retina.

EXAMPLE 3

Far-point and near-point distance of the eye of 2.00 diopters of accommodation and 3.00 diopters of power of the hyperopia If 3.00 of scale (B) is stopped at right 2.00 of scale (A), then the far-point distance is indicated as 33 cm of the distance behind the retina on scale (C), and the near-point distance is indicated as 100 cm of the distance behind the retina on scale (D) by near-point arrow mark (0). When power of the hyperopia is larger than accommodation, then both farpoint and near-point appear behind the retina.

EXAMPLE 4

Far-point and near-point distance of the eye of 1.00 diopter of power of the myopia and 2.00 diopters of accommodation If 1.00 of scale (B) is stopped at left 2.00 of scale (A), then the far-point distance is indicated as 100 cm on scale (C), and the near-point distance is indicated as 33 cm on scale (D) by arrow mark (0).

EXAMPLE 5

Addition required when the eye of 1.00 diopter of accommodation is working at 40 cm of the objective working distance with no asthenopia based on accommodation Arrow mark (2) on the slide rule is stopped at 40 of scale (D), because 1.00 diopter of scale (A) is on the second region 0.50–1.50, so that arrow mark (2) is employed. The necessary addition is indicated as 2.00 diopters of scale (B) corresponding to 1.00 diopter of scale (A). Summation of addition and power of the ametropia is the correct-power for doing the near work.

EXAMPLE 6

Accommodation, power of the ametropia, visual range and addition, from 33 cm of near-point distance and 100 cm of far-point distance The arrow mark (0) of the slide rule is stopped at 33 of scale (D). Power of the ametropia (myopia) is indicated as 1.00 diopter (minus) of scale (B) corresponding to 100 cm of far-point distance of scale (C). Accommodation is indicated as 2.00 diopters corresponding to 1.00 of scale (B) and 100 of scale (C). The visual range is 33–100 cm. In this case, the arrow mark (4) of the slide rule is stopped at 40 cm of scale (D) or the objective working distance that means the real working distance, because 2.00 of accommodation of scale (A) belongs to the fourth region, so that the value of scale (B) corresponding to 2.00 of scale (A) is read as 1.50 diopters, which is the necessary addition. The visual range on 1.50 diopters of addition is 67 cm–29 cm, 67 cm being the far-point distance on scale (C), and 29 cm being the near-point distance on scale (D). This means that the eye of 2.00 diopters of accommodation worn by the eyeglasses of 1.50 diopters of addition can do the work at 40 cm of the objective working distance with no asthenopia based on accommodation.

Degree of heterophoria for distant vision is denoted by unit of prism-diopter; one prism-diopter (represented as $P_1^{\Delta}$) standing for the power of prism that the visual line deviates by 1 cm at the point as much as one meter away from the prism. Degree of heterophoria is measured by means of Maddox rod, and is denoted as one or two prisms, each of which has a prism-diopter and a base at any one direction of four orthogonal directions of upward, downward, inward, and outward. The two prism-diopters and two base-directions have to be resulted to one resultant prism-diopter and one resultant base-direction in order to make the eyeglasses for correcting heterophoria. The resultant base-direction is represented by $\tan^{-1}y/x$, and the resultant prism-diopter is represented by $\sqrt{x^2+y^2}$, provided x and y are the respective values (prism-diopter, base-direction) of one prism.

The resultant prism-diopter and resultant base-direction are obtained as follows:

When the horizontal prism is Base-IN in right eye and Base-OUT in left eye, the right half of rule (E) is used. When the horizontal prism is Base-OUT in right eye and Base-IN in left eye, the left half of rule (E) is used. When the vertical prism is Base-UP, the upward half of rule (E) is used. When the vertical prism is Base-DOWN, th downward half of rule (E) is used.

The horizontal prism-diopter is marked at the horizontal center-line of rule (E), and then the vertical prism-diopter is marked at the vertical center-line of rule (E). The cursor line of rule (F) is coincided at the point consisting of the two marks, so that the value of graduation of the cursor at the point shows the resultant prism-diopter, and the angular degree graduated on the circle of rule (E) acrossed by the cursor line shows the resultant base-direction.

EXAMPLE 7

Resultant prism-diopter and resultant base-direction of the heterophoric eye consisting of right $P_4^{\Delta}$ Base-IN, $P_2^{\Delta}$ Base-UP, and left $P_4^{\Delta}$ Base-IN, $P_2^{\Delta}$ Base-DOWN The first quardrant is used in right eye, because of Base-IN and Base-UP in right eye. Cursor line of rule (F) is stopped at the point (4, 2) of the first quardrant orthogonal coordinates, because of $P_4^{\Delta}$ Base-IN and $P_2^{\Delta}$ Base-UP, so that the scale of cursor line shows, at point (4, 2), 4.5 which is the resultant prism-diopter $P_{4.5}^{\Delta}$, and shows 27° which is the resultant prism base-direction.

The third quardrant is used in left eye, because of Base-IN and Base-DOWN in left eye. Resultant prism-diopter $P_{4.5}^{\Delta}$ and resultant prism base-direction 207° are obtained from the cursor line acrossing the point (4, 2) of the third quardrant orthogonal coordinates.

EXAMPLE 8

Decomposition of resultant prism of $P_5^{\Delta}$ Base 217°

Cursor line of rule (F) is stopped at 217°, and then the coordinates of the point 5 of the cursor is read as (4, 3), which shows $P_4^{\Delta}$ Base-OUT and $P_3^{\Delta}$ Base-DOWN in right eye, and $P_4^{\Delta}$ Base-IN and $P_3^{\Delta}$ Base-DOWN in left eye.

According to the calculating rule of this invention, (1) Far-point distance and near-point distance can be obtained at once from power of the ametropia and accommodation.

(2) Addition necessary for doing the near work with no asthenopia based on accommodation can be obtained at once from accommodation and objective working distance.

(3) Visual range can be obtained at once from accommodation and addition.

(4) Accommodation, power of the ametropia, visual range and objective working distance can be obtained at once from near-point distance and far-point distance.

(5) Resultant prism-diopter and base-direction of the prism lens for correcting heterophoria can be obtained at once from the two prisms representing the degree of heterophoria measured by means of Maddox rod.

The performances of (2), (4) and (5) are the new ones that the invention of Japanese patent publication No. 7839/1978 could not perform.

What is claimed is:

1. A calculating rule which comprises a rule for ametropia and a rule for heterophoria: the rule for ametropia consisting of a rectangular fixed rule and a rectangular slide rule; the fixed rule having two scales (A) and (D) that are apart from each other, the upper scale (A) being the scale for accommodation in dioptric units and the lower scale (D) being the scale for near-point distance and also objective working distance in centimeter units; the scale (A) consisting of a left half scale used for the calculation in the case of both emmetropia and myopia and a right half scale used for the calculation in the case of hyperopia, each half scale graduated from the center at 0 to each end at 4.00 and the scale (D) consisting of a left half scale which is used for emmetropia and myopia and represents the value before the retina, and a right half scale which is used for hyperopia and represents the value behind the retina; the slide rule that slides between the scales (A) and (D) of the fixed rule having a scale (B) for power of the ametropia in dioptric units that is also the scale for addition in dioptric units, and a scale for (C) for far-point distance in centimeter units, the scale (B) graduated from 0 at the left end to 8.00 at the right end, and the scale (C) graduated from 12.5 at the right end to infinity (∞) at the left end; the slide rule also having, at the left end of the scales (B) and (C), an arrow mark (0) for designating the near-point distance on the scale (D); the rule for ametropia further having indicia on scale (A) dividing the left half of the accommodation scale (A) into several regions (1), (2), (3), . . . , and several arrow marks (1), (2), (3), . . . disposed to the right of arrow mark (O) on the slide rule, corresponding in number to the several regions (1), (2), (3), . . . , each of which designates a respective objective working distance on scale D standing for the distance at which the eye having a value of accommodation in a definite region has to see and can continue to see with no asthenopia based on accommodation; and the rule for heterophoria consisting of a fixed circular rule (E) and a rotating circular rule (F); the fixed circular rule (E) having a counterclockwise circular scale graduated from zero to 360, in which the horizontal center-line and the vertical center-line into four guardrants, each of which graduates cross-sectionally in orthogonal coordinates 0, 1, 2, 3, 4, 5 . . . and labeled UP for the upward first and second quardrants, and labeled OUT-R-IN and IN-L-OUT which span the vertical center-line, in which R represents right eye, L represents left eye, OUT represents inward; (nose-side); and the rotating circular scale (F) is a transparent circular plate rotating at the axis that is the center of the fixed circular rule (E), which has a cursor that is a straight center-line graduated 0, 1, 2, 3, 4, 5, 6, 7 from the center in both directions with the same graduation as the fixed circular scale (E).

2. The calculating rule as claimed in claim 1, wherein the several regions of the left half of scale (A) are four regions consisting of a first region ranging from 0 to 0.50, a second region ranging from 0.50–1.50, a third region ranging from 1.50 to 2.00, and a fourth region ranging from 2.00 to 4.00, wherein the marks designating objective working distances on scale (D) consist of mark (1) corresponding to the first region, mark (2) corresponding to the second region, mark (3) corresponding to the third region, and mark (4) corresponding to the fourth region, and wherein mark (1) is located on the slide rule at 1,2 graduates-distance (0.3 d) from mark (0), mark (2) is located on the slide rule at 2.2 graduates-distance (0.55 d) from mark (0), mark (3) is located on the slide rule at 2.8 graduates-distance (0.7 d) from mark (0), and mark (4) is located on the slide rule at 3.7 graduates-distance (0.925 d) from mark (0).

* * * * *

UNITED STATES PATENT AND TRADEMARK OFFICE

CERTIFICATE OF CORRECTION

PATENT NO. : 4,350,877

DATED : September 21, 1982

INVENTOR(S) : Yasuo Yanagisawa et al

It is certified that error appears in the above—identified patent and that said Letters Patent is hereby corrected as shown below:

Col. 6, line 58, after "which" insert --the horizontal center-line is 0-180° and the vertical center-line is 90-270°, and the circular space which is divided by".

Signed and Sealed this

*Twelfth* Day of *July 1983*

[SEAL]

*Attest:*

GERALD J. MOSSINGHOFF

*Attesting Officer*

*Commissioner of Patents and Trademarks*